United States Patent [19]

Szabo

[11] 4,191,232

[45] Mar. 4, 1980

[54] DUPLEX HANDLES OF MOLDED PLASTIC MATERIAL

[75] Inventor: Bela G. Szabo, Carnegie, Pa.

[73] Assignee: Bruce Plastics, Inc., Pittsburgh, Pa.

[21] Appl. No.: 4,927

[22] Filed: Jan. 19, 1979

[51] Int. Cl.[2] ..... B65D 33/06

[52] U.S. Cl. ..... 150/12; 16/125

[58] Field of Search ..... 150/12, 33, 1.7; 229/54 R, 52 A, 52 AL; 16/125, 110 R; 190/58 R, 58 C

[56] References Cited

U.S. PATENT DOCUMENTS

| | | | |
|---|---|---|---|
| 1,223,420 | 4/1917 | Pomper | 190/58 R X |
| 2,036,645 | 4/1936 | Schell | 150/12 |
| 2,128,723 | 8/1938 | Zettler | 229/52 A |
| 2,483,307 | 9/1949 | Wheary | 190/58 R |
| 2,589,438 | 3/1952 | Schneider | 150/12 |
| 3,145,050 | 8/1964 | Edwards | 16/110 R X |
| 3,176,326 | 4/1965 | Zysman | 150/33 X |

*Primary Examiner*—Donald F. Norton
*Attorney, Agent, or Firm*—Samuel Lebowitz

[57] ABSTRACT

Duplex flexible handles of molded plastic material for connection to luggage bags or receptacles of limp material having spaced pockets at the upper portions of the opposite sides of the receptacles. Each handle is provided with a hand-hold at the top and with legs extending downwardly from the opposite ends thereof which terminate in flattened extremities of reduced cross-section, and spaced from each other correspondingly to the spacing between the pockets. An upwardly directed barb extends laterally from each extremity. A horizontal bead or enlargement is molded at the junction of the upper end of each extremity and the lower end of the exposed portion of each leg, for limiting the extent of penetration of each leg within its pocket, through a horizontal slot in the latter slightly wider than the extremity, but less than the width of the bead. In the course of the assembly operations of the handles and bags, the barbs yield when the legs are inserted in the respective pockets but are trapped by the upper edges of the slots in the course of possible reverse movement, so that the component parts remain in place preparatory to the driving of rivets through the handle extremities and the sides of the pockets of the luggage bags.

1 Claim, 4 Drawing Figures

Fig. 1
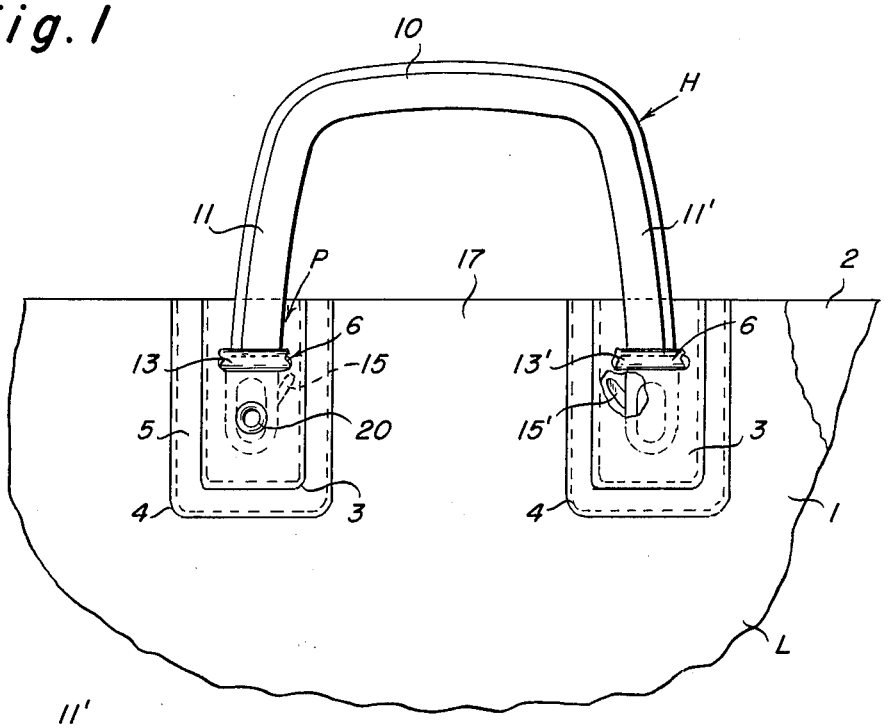
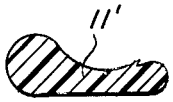
Fig. 4
Fig. 2
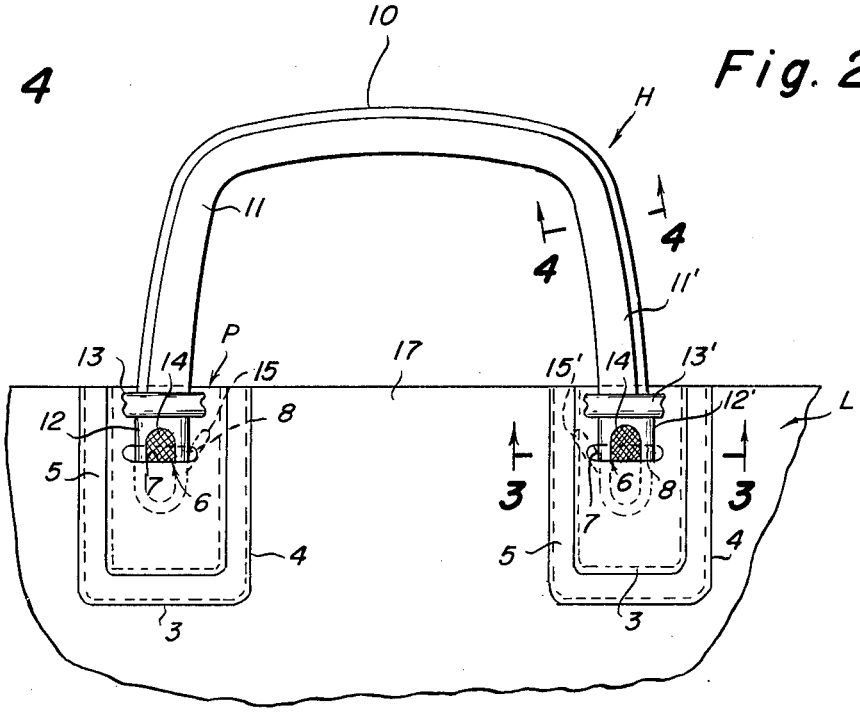
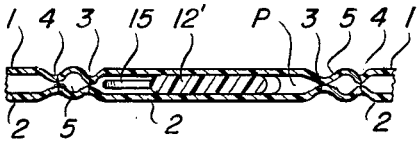
Fig. 3

DUPLEX HANDLES OF MOLDED PLASTIC MATERIAL

This invention relates to duplex handles of molded plastic material designed for attachment to luggage bags and similar receptacles of limp material.

It is the object of the present invention to improve upon the luggage handles disclosed in my U.S. Pat. No. D-248,011, May 30, 1978.

It is another object of the present invention to provide luggage handles which effect a saving in material, improve the workability of the handles, enhance the durability thereof, and most importantly result in savings of labor in the course of assembling the handles with the luggage bags or receptacles.

The above objectives are attained by molding the extremities of the legs of the handles of thinner material and, in addition, by providing a laterally extending barb on each extremity which presents no impediment to the insertion of the respective handle legs into the pockets therefor, and which are locked against withdrawal therefrom during the assembling operation preparatory to the integration of the handles with the luggage bags, generally by a riveting operation.

Other objects and purposes will appear from the detailed description of the invention following hereinafter taken in conjunction with the accompanying drawing, wherein FIG. 1 is a front elevation of the improved handle in accordance with the invention mounted on the upper portion of a luggage bag, with a part thereof cut away to illustrate the invention more clearly;

FIG. 2 is a view similar to FIG. 1 at an intermediate stage of production, illustrating the insertion of the legs of the handle into the pockets therefor;

FIG. 3 is a horizontal sectional view along line 3—3 of FIG. 2; and

FIG. 4 is a fragmentary sectional view taken along line 4—4 of FIG. 2, on an enlarged scale.

The drawing illustrates a preferred embodiment of a luggage handle H in accordance with the invention molded of plastic material for affixation to the upper portions of luggage bags or other receptacles of limp material of textile or plastics. The luggage bag L is preferably formed of doubleply plastic sheeting 1 and 2 which lends itself to heat stitching by different forms of electrical energy, as is well known in the art.

As shown in the drawing, a pair of laterally displaced pockets P are formed at the top of the bag by displaced rows of stitches 3 and 4 forming an ornamental rectangular bead 5 therebetween.

A horizontal slot 6 is cut in the outer surface 1 in each of the pockets, having a lower edge 7 and an upper edge 8 functioning in the manner described below. These slots are preferably disposed above the midportion of the pockets to leave sufficient room for the leg extremities therebelow.

The invention seeks to obviate the difficulties encountered heretofore during the assembly of handles with luggage bags incidental to the insertion of the legs into the pockets through the slots, preparatory to joining them by rivets. The combined bags and handles are thrown into a collecting bin or onto a conveyor preparatory to the riveting operation. In many cases the extremities of the handles slide out of the pockets so that it is necessary for the operators to re-insert the handles into the pockets which, understandably, cause delays in production and interference with the riveting operations. The handles disclosed herein overcome this difficulty.

The contour of the handle may be similar to that shown in applicant's earlier U.S. Pat. No. D-248,011 and may be textured or contoured in different ways. The handhold of the handle is formed by a midportion 10 with legs 11,11' extending downwardly from the opposite ends thereof. The extremities 12,12' are molded of thinner material in order to increase the flexibility of the handle at these points which not only results in a saving of material, but reduces the possibilities of cracking of the handle parts. The extremities are roughened on the opposite faces thereof by means of projections, serrations, patterned indentations 14 and the like, to increase the frictional adherence between these extremities and the faces of sheet material within the pockets.

Horizontal beads 13,13' are provided at the junctions between the upper portions of the extremities 12,12' and the lower ends of the exposed portions of handle legs 11,11', respectively, and afford a reliable stop against the insertion of the handles past the slots 6.

The barbs 15 extend upwardly at an acute angle from the inner portions of the extremities and preferably are molded to a thickness of only one-half of that of the extremities 12,12', which increases their flexibility. These barbs offer no impediment to the insertion of the extremities into the respective pockets which, as shown in FIG. 2, flex in the direction towards the inner sides of the extremities as the latter are inserted into the pockets. Once these barbs pass the slots 6 they spring outwardly and accidental withdrawal of the handle is prevented by the upper edge of the slot 8 being trapped in the corner between the barb and the extremity. When the riveting operator receives the combined bag and handles, all that need be done is to apply the rivet 20 to the pocket P after making certain that the handle is inserted to the proper extent, which is assured by the engagement of the bead 13 with the slot 6. As is apparent, the slots 6 are slightly wider than the extremities 12,12', but are shorter than the width of the beads 13,13'.

It is understood that the luggage bags may be finished in any desired manner, for example, by forming additional stitched panels in the space 17 between the pockets for the insertion of identifying data.

Also, intermediate panels between the sides of the bag may be sewn thereto at the upper edges and may be provided with slide fasteners or any other type of closure, as is well known in the art.

Variations may be made to the above-described features without departing from the spirit of the invention. The barbs on the extremities may extend laterally from the outer edges thereof, or two may be used, one extending from each side. If desired, the barbs may be of a thickness corresponding to that of the extremities, by casting a semi-cylindrical section in each half of the mold. Other changes may suggest themselves to those skilled in the art, which fall within the purview of the invention as defined in the following claims.

I claim:

1. A limp receptacle comprising a pair of flexible sides, each having a pair of spaced pockets adjacent the upper edge thereof for receiving a U-shaped flexible handle of molded plastic material, said handle comprising a hand-hold at its midportion and a pair of legs extending from the opposite ends thereof and terminating in free extremities for connection to each side at said pockets, an integral flexible barb molded to each leg adjacent to each extremity and extending transversely therefrom for entrapment within each pocket to restrain withdrawal therefrom preparatory to the permanent connection therebetween, an enlargement at the lower end of each leg above said extremity and barb, adapted to limit the entry of said legs into the respective spaced pockets, and a rivet fastening each handle extremity to the side of the receptacle at said pockets.

* * * * *